US009668050B2

(12) United States Patent
Akino

(10) Patent No.: US 9,668,050 B2
(45) Date of Patent: May 30, 2017

(54) IMPEDANCE CONVERSION CIRCUIT OF CONDENSER MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 15/229,697

(22) Filed: Aug. 5, 2016

(65) Prior Publication Data

US 2017/0099544 A1 Apr. 6, 2017

(30) Foreign Application Priority Data

Oct. 5, 2015 (JP) ..... 2015-197882

(51) Int. Cl.
*H04R 3/00* (2006.01)
*H04R 3/06* (2006.01)

(52) U.S. Cl.
CPC ..... *H04R 3/06* (2013.01)

(58) Field of Classification Search
CPC ... H04R 1/04; H04R 3/00; H04R 3/06; H04R 19/00; H04R 19/016; H04R 19/04
USPC ..... 381/113, 111, 355, 369
See application file for complete search history.

(56) References Cited

U.S. PATENT DOCUMENTS 4,918,394 A * 4/1990 Modafferi ..... H03F 5/00 330/118
2016/0156321 A1* 6/2016 Akino ..... H03F 1/56 381/113

FOREIGN PATENT DOCUMENTS

JP 3890301 B2 3/2007
JP 4426902 B2 3/2010

* cited by examiner

*Primary Examiner* — Paul S Kim
*Assistant Examiner* — Sabrina Diaz
(74) *Attorney, Agent, or Firm* — Manabu Kanesaka

(57) ABSTRACT

Provided is an impedance conversion circuit of a condenser microphone which includes a first electron tube operated in grounded-cathode mode to whose grid an output signal from a condenser microphone unit is inputted, and from whose plate a signal is outputted, a first emitter-follower circuit configured to receive a signal based on a plate output of the first electron tube and amplify a current, and a first feedback element configured to transmit a feedback signal from an emitter of a transistor configuring the first emitter-follower circuit to the grid of the first electron tube. And the impedance conversion circuit can achieve a wide dynamic range while using a voltage amplifier circuit with an electron tube at an initial stage.

7 Claims, 2 Drawing Sheets

IMPEDANCE CONVERSION CIRCUIT OF CONDENSER MICROPHONE

RELATED APPLICATIONS

The present application is based on, and claims priority from, Japanese Application No. JP2015-197882 filed Oct. 5, 2015, the disclosure of which is hereby incorporated by reference herein in its entirety.

BACKGROUND OF THE INVENTION

Field of the Invention

The present invention relates to an impedance conversion circuit of a condenser microphone using an electron tube (vacuum tube).

Description of the Related Art

A condenser microphone generates an audio signal based on change of an electrostatic capacitance between a diaphragm and a fixed electrode facing each other.

That is, the condenser microphones in which the diaphragm is arranged to face the fixed electrode have an electrostatic capacitance of about several tens of pF and extremely high output impedance, and are thus configured to take out the audio signal through an impedance conversion circuit.

An impedance conversion circuit with a field effect transistor (FET) or an electron tube (vacuum tube) is used for the condenser microphones. Especially, a product of a condenser microphone is provided for studio sound collection using the electron tube for the impedance conversion circuit to improve sound quality.

Among the impedance conversion circuits using the electron tube, there are a current amplifier circuit called a grounded-anode circuit or a cathode-follower circuit, and a grounded-cathode voltage amplifier circuit.

Typically, it is known that a tone color of the microphone with the cathode-follower as the impedance conversion circuit has a tone color close to the condenser microphone using the field effect transistor.

Meanwhile, the condenser microphone using the above-described voltage amplifier circuit for the impedance conversion circuit has a distinctive tone color mentioned "typical vacuum tube sound", which is different from that of the cathode follower circuit, and this tone color has firm popularity.

The former cathode follower circuit can achieve a wide dynamic range of output, that is, the range between the lowest level limited by residual noise and the largest level limited by distortion.

However, in the latter voltage amplifier circuit, a signal level where distortion occurs is lower than the cathode follower circuit case, and thus a maximum allowable input sound pressure level as a microphone decreases. Therefore, securing of a wide dynamic range is desired when using the voltage amplifier circuit with the vacuum tube as the impedance conversion circuit of a condenser microphone.

Therefore, to expand the dynamic range in the impedance conversion circuit using the voltage amplifier circuit, means for applying negative feedback is employable. That is, a signal source is an electrostatic capacitance (capacitor), and thus a capacitor is connected from a plate to a grid of an inverting amplifier using the electron tube, so that a signal generated on the plate can be fed back to the grid. This is called PG (plate-grid) feedback, and an impedance conversion circuit to which the PG feedback is applied is disclosed in JP 3890301 B2, JP 4426902 B2, and the like.

By the way, according to the configurations of the PG feedback circuit disclosed in JP 3890301 B2 and JP 4426902 B2, even if the feedback amount is tried to be increased to expand the dynamic range, the plate of the electron tube that configures the voltage amplifier circuit has high impedance, and thus has limitations to increase the amount of the feedback.

Therefore, the applicant of the present invention has previously proposed an impedance conversion circuit that can provide a larger feedback amount to an electron tube that configures a voltage amplifier circuit.

FIG. 3 illustrates the configuration of the impedance conversion circuit previously proposed by the applicant. In this example, a second electron tube T2 is provided which configures a PK (plate-cathode) division circuit that receives a plate output of a first voltage amplifier tube denoted by T1. Then, a feedback signal is provided through a capacitor Ck from a cathode of the second electron tube T2 to the grid of the first electron tube T1.

Note that, in the example illustrated in FIG. 3, the entire configuration except the configuration of the feedback circuit with the capacitor Ck is the same as an embodiment according to the invention described below. Therefore, detailed description of the entire circuit will be described below with reference to FIG. 1.

According to the impedance conversion circuit illustrated in FIG. 3, output impedance of the cathode of the second electron tube T2 is lower than output impedance of the plate of the first electron tube T1. Therefore, a negative feedback amount to the grid of the first electron tube T1 can be increased. Accordingly, this impedance conversion circuit allows the voltage amplifier circuit to achieve a wider dynamic range, and to improve total harmonic distortion characteristics against an input level.

SUMMARY OF THE INVENTION

The impedance conversion circuit illustrated in FIG. 3 can provide a larger feedback amount than the circuits disclosed in JP 3890301 B2 and JP 4426902 B2, which configure the PG feedback circuits in the voltage amplifier tube, and can secure a wide dynamic range according to the larger feedback amount.

However, according to the impedance conversion circuit illustrated in FIG. 3, there is a technical drawback that the dynamic range is slightly narrower than the impedance conversion circuit of a condenser microphone using the field effect transistor, and obtaining a wider dynamic range is desired.

An objective of the present invention is to provide, in an impedance conversion circuit of a condenser microphone using a grounded-cathode voltage amplifier circuit as an initial-stage input, an impedance conversion circuit of a condenser microphone, which can achieve a wide dynamic range and can increase a maximum output level and reduce a noise level, by providing a larger feedback amount to an electron tube of the initial-stage input.

In order to solve the above issue, an impedance conversion circuit of a condenser microphone according to the present invention includes: a first electron tube operated in grounded-cathode mode to whose grid an output signal from a condenser microphone unit is inputted, and from whose plate a signal is outputted; a first emitter-follower circuit configured to receive a signal based on a plate output of the first electron tube and amplify a current; and a first feedback element configured to transmit a feedback signal from an emitter of a transistor configuring the first emitter-follower circuit to the grid of the first electron tube.

In this case, a configuration is preferably employed in which the plate output signal of the first electron tube is inputted to a grid of a second electron tube, and a PK division circuit that provides signals having phases reverse to each other is formed of a plate and a cathode of the second electron tube, and a cathode output signal of the second electron tube is supplied to a base of a transistor configuring the first emitter-follower circuit.

In addition, a plate output signal of the second electron tube is supplied to a base of a transistor configuring a second emitter-follower circuit, and a second feedback element that transmits a feedback signal from an emitter of the transistor to a cathode of the first electron tube is provided.

Then, the emitter of the transistor configuring the first emitter-follower circuit and the emitter of the transistor configuring the second emitter-follower circuit configure output terminals of a balanced output signal of a condenser microphone.

Further, the first feedback element from the first emitter-follower circuit is desirably a capacitor, and the second feedback element from a second emitter-follower circuit is desirably a resistor.

Then, the first and second electron tubes are preferably each of a dual triode electron tube.

According to the impedance conversion circuit of a condenser microphone according to the present invention, the first electron tube operated in grounded-cathode mode configures a voltage amplifier circuit. Accordingly, an audio signal having a tone color unique to the voltage amplifier circuit with the electron tubes can be obtained.

Further, the feedback signal is transmitted from the first emitter-follower circuit having low output impedance to the grid of the first electron tube through the first feedback element, and thus the negative feedback amount can be increased. Accordingly, the impedance conversion circuit of a condenser microphone having a wide dynamic range using the voltage amplifier circuit can be provided.

In addition, a multi-feedback circuit that transmits the feedback signal from the second emitter-follower circuit to the cathode of the first electron tube through the second feedback element is configured, whereby the negative feedback amount can be further increased. Accordingly, the impedance conversion circuit of a condenser microphone can be provided which can achieve a wider dynamic range, increase of a maximum output level and reduction of a noise level.

DESCRIPTION OF THE PREFERRED EMBODIMENTS

Figure 1:
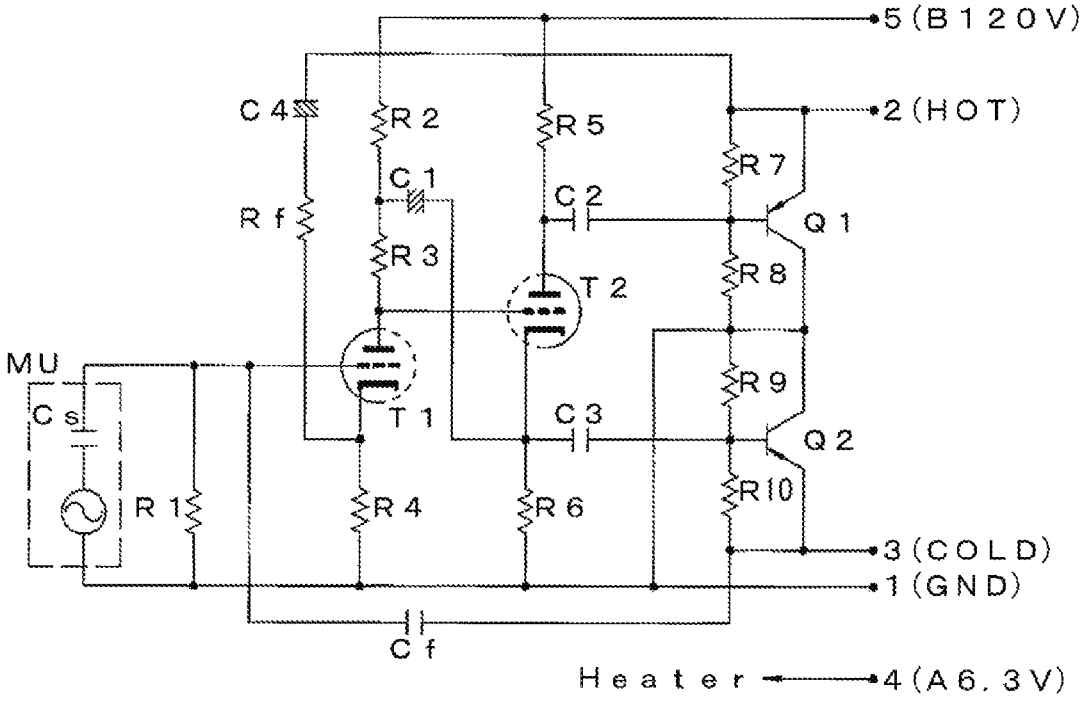
FIG. 1 is a circuit configuration diagram illustrating an example of an impedance conversion circuit of a condenser microphone according to the present invention.

An impedance conversion circuit of a condenser microphone according to the present invention will be described with reference to FIG. 1.

Reference symbol MU represents a condenser microphone unit by an equivalent circuit. The condenser microphone unit is expressed such that a capacitor Cs is connected to a signal source in series. That is, the capacitor Cs corresponds to an electrostatic capacitance between a fixed electrode and a diaphragm that configure the condenser microphone unit, and its capacitance is about several tens of pF, as described above.

Then, one end of the condenser microphone unit MU is connected to a grid of a first electron tube T1, and the other end is connected to a terminal pin 1 of a connector as a ground line.

A grid leak resistor R1 is connected between the grid of the first electron tube T1 and the ground line. Further, a load resistor made of a series circuit of resistors R2 and R3 is connected to a plate of the first electron tube T1, and one end of the load resistor R2 is connected to a terminal pin 5 of a connector that receives a direct current operation power ("B" power supply).

Further, a cathode resistor R4 is connected between a cathode of the first electron tube T1 and the ground line. Accordingly, the first electron tube T1 configures a voltage amplifier circuit of grounded-cathode type.

A grid of a second electron tube T2, configuring a dual triode electron tube together with the first electron tube T1, is directly connected to the plate of the first electron tube T1. Then, a load resistor R5 is connected between a plate of the second electron tube T2 and the terminal pin 5, and the plate of the second electron tube T2 is connected to the B power supply through the load resistor R5. Further, a load resistor R6 is connected between a cathode of the second electron tube T2 and the ground line.

Then, values of the load resistors R5 and R6 are set to be nearly the same. Accordingly, a PK division circuit is configured, which provides signals, having nearly the same level with phases reverse to each other, on the plate and the cathode of the second electron tube T2. That is, a balanced output signal of the condenser microphone can be obtained by the PK division circuit.

Note that a capacitor C1 is connected between the cathode of the second electron tube T2 and a connection midpoint of the resistors R2 and R3 that are load resistors of the plate of the first electron tube T1.

This capacitor C1 provides a signal having the same phase as a signal on the plate of the first electron tube T1 from the cathode of the second electron tube T2 to the connection midpoint of the resistors R2 and R3. Accordingly, the first electron tube T1 configures a bootstrap circuit.

Direct current (DC) cut capacitors C2 and C3 are respectively connected to the plate and the cathode of the second electron tube T2. The balanced output signal of the condenser microphone is supplied to base electrodes of transistors Q1 and Q2 through the DC cut capacitors C2 and C3.

The transistors Q1 and Q2 respectively configure emitter-follower circuits, and respective collector electrodes are connected to the ground line.

The emitter-follower circuit including the transistor Q1 includes bias setting resistors R7 and R8. Then, an emitter electrode of the transistor Q1 is connected to a terminal pin 2 of a connector as a hot output terminal.

Similarly, the emitter-follower circuit including the transistor Q2 includes bias setting resistors R9 and R10. Then, an emitter electrode of the transistor Q2 is connected to a terminal pin 3 of the connector as a cold output terminal.

Further, a first feedback element by a capacitor Cf is connected from an emitter of the emitter-follower circuit (also called first emitter-follower circuit) including the transistor Q2 to the grid of the first electron tube T1. Accordingly, the first electron tube T1 functions as a voltage amplifier circuit with a grid to which negative feedback is applied.

Further, a resistor Rf of a second feedback element is connected from an emitter of the emitter-follower circuit (also called second emitter-follower circuit) including the transistor Q1 to the cathode of the first electron tube T1. Accordingly, the first electron tube T1, also to whose cathode negative feedback is applied, functions as a voltage amplifier circuit. Note that, in this circuit configuration, a DC cut capacitor C4 is connected in series to the resistor Rf of the second feedback element.

A DC power from a phantom power supply (not shown) mounted at a mixer circuit side is supplied to the terminal pins 2 and 3 of the connector. Accordingly, the two emitter-follower circuits operate on the DC power supplied to the terminal pins 2 and 3. Note that, in the two emitter-follower circuits, DC supply resistors which are not shown (for example, 6.8 KΩ) arranged at the phantom power supply side respectively function as emitter resistors, and serve as current amplifying function.

Further, a terminal pin 4 of the connector receives a heater power (A power supply) for the first electron tube T1 and the second electron tube T2 (a dual triode electron tube).

Figure 2:
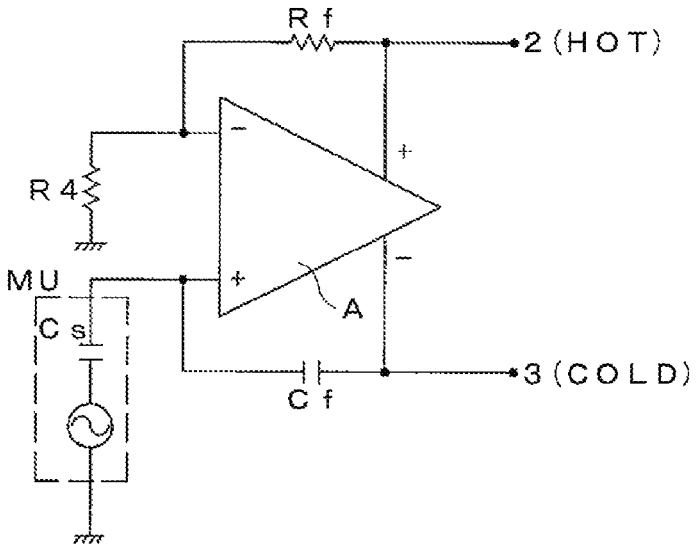
FIG. 2 is an equivalent circuit diagram of the impedance conversion circuit illustrated in FIG. 1 including two feedback circuits.

FIG. 2 illustrates an equivalent circuit diagram of the impedance conversion circuit illustrated in FIG. 1 including two feedback circuits. As illustrated in FIG. 2, the impedance conversion circuit of the condenser microphone according to the present embodiment can be regarded as an impedance conversion circuit A where the grid of the first electron tube T1 is a non-inverting input terminal, and the cathode of the first electron tube T1 is an inverting input terminal.

Then, the negative feedback is applied from the emitter of the transistor Q2 connected to the cold output terminal (terminal pin 3) to the non-inverting input terminal of the impedance conversion circuit A through the first feedback element (capacitor Cf). In this case, the emitter of the transistor Q2 has extremely low output impedance. Therefore, by selecting the electrostatic capacitance of the capacitor Cf as the feedback element, sufficient negative feedback can be applied to the non-inverting input terminal. A feedback factor of this case is determined by a relationship between the electrostatic capacitance of the capacitor Cf as the first feedback element and an electrostatic capacitance of the capacitor Cs at the condenser microphone unit MU.

Meanwhile, the negative feedback is applied from the emitter of the transistor Q1 connected to the hot output terminal (terminal pin 2) to the inverting input terminal of the impedance conversion circuit A through the second feedback element (resistor Rf). In this case, the emitter of the transistor Q1 has also extremely low output impedance. Therefore, by selecting the value of the resistor Rf as the feedback element, sufficient negative feedback can be applied to the inverting input terminal. The feedback factor of this case is determined by the value of the resistor Rf as the second feedback element and the value of the cathode resistor R4 of the first electron tube T1.

According to the impedance conversion circuit of the present embodiment, a multi-feedback circuit is configured using each of the balanced output signals from the first and second emitter-follower circuits.

Therefore, the negative feedback amount as the entire circuit can be set to be larger, and the impedance conversion circuit of the condenser microphone having sufficient specific characteristics of the negative feedback circuit can be provided.

Figure 3:
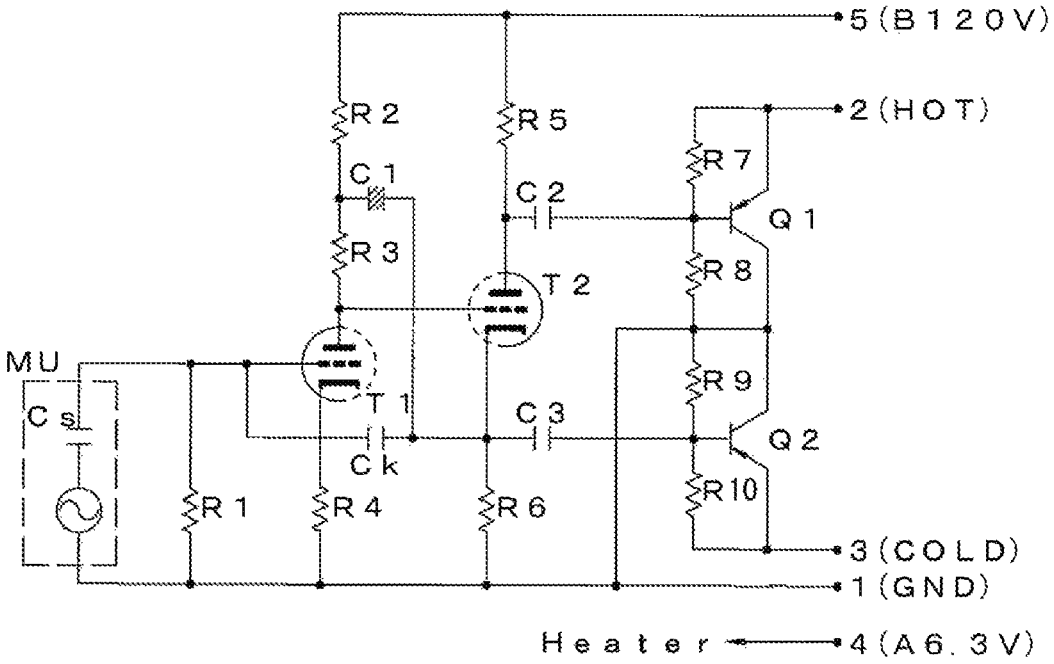
Fig. 3 Prior Art
FIG. 3 is a circuit configuration diagram illustrating an example of an impedance conversion circuit of a condenser microphone according to a prior patent application of the applicant of this case.

Table 1 illustrates comparison of characteristics between the impedance conversion circuit according to the present invention illustrated in FIG. 1 and the impedance conversion circuit illustrated in FIG. 3 previously proposed by the applicant of this case.

TABLE 1

| | Unit | Example of FIG. 1 | Example of FIG. 3 |
|---|---|---|---|
| Gain | [dB] | −0.93 | 4.85 |
| Maximum input level | [dBV] | 22.4 | 10 |
| Maximum output level | [dBV] | 21.47 | 14.85 |
| Signal-to-noise ratio | [dB] | 91 | 78 |
| Dynamic range | [dB] | 138.4 | 117.9 |

As illustrated in Table 1, according to the impedance conversion circuit according to the present invention, which is indicated as "Example of FIG. 1", the dynamic range can be especially enlarged, compared with the previously proposed impedance conversion circuit indicated as "Example of FIG. 3". This has characteristics equivalent to an impedance conversion circuit of a condenser microphone using a field effect transistor for an initial stage.

Then, as shown in Table 1, according to the impedance conversion circuit according to the present invention, the maximum output level can be increased, and the noise level can be reduced, as seen in the signal-to-noise ratio row.

What is claimed is:

1. An impedance conversion circuit of a condenser microphone comprising:

a first electron tube operated in grounded-cathode mode to whose grid an output signal from a condenser microphone unit is inputted, and from whose plate a signal is outputted;

a first emitter-follower circuit configured to receive a signal based on a plate output of the first electron tube and amplify a current; and a first feedback element configured to transmit a feedback signal from an emitter of a transistor configuring the first emitter-follower circuit to the grid of the first electron tube.

2. The impedance conversion circuit of a condenser microphone according to claim 1, wherein a plate output signal of the first electron tube is inputted to a grid of a second electron tube, a PK division circuit that provides signals having phases reverse to each other is formed of a plate and a cathode of the second electron tube, and a cathode output signal of the second electron tube is supplied to a base of the transistor that configures the first emitter-follower circuit.

3. The impedance conversion circuit of a condenser microphone according to claim 2, wherein a plate output signal of the second electron tube is supplied to a base of a transistor configuring a second emitter-follower circuit, and a second feedback element that transmits a feedback signal from an emitter of the transistor to a cathode of the first electron tube is included.

4. The impedance conversion circuit of a condenser microphone according to claim 3, wherein the emitter of the transistor configuring the first emitter-follower circuit and the emitter of the transistor configuring the second emitter-follower circuit configure output terminals of a balanced output signal of the condenser microphone.

5. The impedance conversion circuit of a condenser microphone according to claim 3, wherein the first feedback element is a capacitor, and the second feedback element is a resistor.

6. The impedance conversion circuit of a condenser microphone according to claim 2, wherein the first and second electron tubes are each of a dual triode electron tube.

7. The impedance conversion circuit of a condenser microphone according to claim 2, wherein a first load resistor is connected to the plate of the second electron tube, a second load resistor is connected to the cathode of the second electron tube, values of the first and second load resistor are nearly the same.

* * * * *